US008408390B2

(12) United States Patent
Rennecamp

(10) Patent No.: US 8,408,390 B2
(45) Date of Patent: Apr. 2, 2013

(54) SMOKING ACCESSORY

(76) Inventor: Bryan R. Rennecamp, St. Louis, MO (US)

( * ) Notice: Subject to any disclaimer, the term of this patent is extended or adjusted under 35 U.S.C. 154(b) by 53 days.

(21) Appl. No.: 13/015,795

(22) Filed: Jan. 28, 2011

(65) Prior Publication Data

US 2011/0180433 A1 Jul. 28, 2011

Related U.S. Application Data

(60) Provisional application No. 61/336,955, filed on Jan. 28, 2010.

(51) Int. Cl.
*A24F 15/00* (2006.01)

(52) U.S. Cl. ..... 206/268; 206/244; 220/262; 220/326; 220/844; 220/848

(58) Field of Classification Search ..... 206/244, 206/268, 86; 132/241, 242; 220/843, 844, 220/848, 263, 264, 326, 324
See application file for complete search history.

(56) References Cited

U.S. PATENT DOCUMENTS

| | | | | |
|---|---|---|---|---|
| 1,706,244 | A * | 3/1929 | Meyerson | 131/242 |
| 1,840,664 | A * | 1/1932 | Gerstheimer | 206/246 |
| 2,996,068 | A * | 8/1961 | Bosko et al. | 131/237 |
| 3,166,080 | A * | 1/1965 | Neale | 131/241 |
| 4,223,687 | A * | 9/1980 | Sandeen | 131/180 |
| 5,125,531 | A * | 6/1992 | Wentz | 220/849 |
| 5,810,164 | A * | 9/1998 | Rennecamp | 206/256 |
| 6,050,441 | A * | 4/2000 | Kuo | 220/324 |
| 6,070,591 | A * | 6/2000 | Bryer | 131/233 |
| 6,446,793 | B1 * | 9/2002 | Layshock | 206/86 |
| 7,416,078 | B2 * | 8/2008 | Willis | 206/236 |
| 2002/0088469 | A1 * | 7/2002 | Rennecamp | 131/330 |
| 2004/0216753 | A1 * | 11/2004 | Fox | 131/242 |
| 2005/0247582 | A1 * | 11/2005 | Rennecamp | 206/236 |
| 2007/0107741 | A1 * | 5/2007 | Zeanah et al. | 131/231 |
| 2009/0314662 | A1 * | 12/2009 | Kerlind | 206/86 |
| 2011/0100992 | A1 * | 5/2011 | Zhang et al. | 220/324 |

* cited by examiner

*Primary Examiner* — David Fidei
(74) *Attorney, Agent, or Firm* — Senniger Powers LLP

(57) ABSTRACT

A smoking accessory. The accessory includes a base having an upper surface with two openings. A first of the openings providing access to a pipe receptacle extending into the base from the first opening. A second of the openings providing access to a tobacco receptacle extending into the base from the second opening. The accessory includes a lid pivotally connected to the base by a hinge located above the upper surface of the base for selective movement in directions toward and away from the smoking pipe receptacle and the tobacco receptacle between an open position and a closed position.

15 Claims, 10 Drawing Sheets

SMOKING ACCESSORY

CROSS REFERENCE TO RELATED APPLICATION

This Application claims priority from U.S. Provisional Patent Application No. 61/336,955 filed on Jan. 28, 2010, which is hereby incorporated by reference in its entirety.

BACKGROUND

The present invention generally relates to a smoking accessory, and more particularly, to an accessory for holding a smoking pipe and loose tobacco.

One type of smoking accessory comprises a base having a first elongate cavity for holding a pipe and a second, larger cavity for holding tobacco. The cavities are selectively covered by a sliding panel, which, for example, slides in a track. Crow U.S. Pat. No. 4,214,658 is an example of this "slide-top" type system. In others, the panel pivots about an axle fixed in the base, as in the "spin-top" type system shown in Rennecamp U.S. Pat. No. 6,736,143.

In another accessory, the panel is replaced with a lid that swings open and away from the base to expose the cavities, as in the "flip-top" type system shown in Jacobs U.S. Pat. No. 5,967,312 entitled FLIP TOP SMOKING SYSTEM. The Jacobs patent depicts a smoking system that utilizes two springs to create a smoking system having a lid mechanism that is activated by pushing on the lower portion of a pivotally mounted lever, which releases the kinetic energy of a compressed spring positioned within the lid of the smoking system. To open the Jacobs smoking system a smoker would push on a lever causing the top portion of the box to flip open. FIG. 2 of Jacobs '312 depicts the smoking system with the front panel removed to expose the entire mechanism. FIG. 2 illustrates that the lid (3) is fastened to the base (27) by means of a fastening pin (5) which is located below the upper surface of the base and below the upper surface of the tobacco receptacle. The lid (3) is fastened to the base (27) below the tobacco receptacle opening located on the upper surface of the base. This design allows tobacco to leak out of the tobacco receptacle when the lid is opened or closed. The "hinge" that is created between the lid and base also comprises the upper portion of one of the four sides of the tobacco receptacle. The opening and closing of the lid allows, if not assists, in the unwanted ejection of loose tobacco from the tobacco receptacle. When the lid is opened, the lowest portion of the lid swings into the tobacco chamber and acts as a scoop that may actually eject a portion of the tobacco from the tobacco receptacle. Also, when closing the lid the same portion of the lid that acts as a scoop during opening could push loose tobacco out the side of the base.

SUMMARY

A main object of this invention is to improve on the prior designs by developing a smoking system having a lever released, spring activated lid mechanism where the hinge mechanism is independent from the tobacco receptacle.

The present invention relates to a smoking accessory comprising a base including an upper surface having two openings. A first opening of the two openings provides access to a pipe receptacle extending into the base from the first opening. The pipe receptacle is sized and shaped for holding a smoking pipe. A second opening of the two openings provides access to a tobacco receptacle adapted for storing tobacco extending into the base from the second opening. The smoking accessory also includes a lid pivotally connected to the base by a hinge located above the upper surface of the base for selective movement in directions toward and away from the smoking pipe receptacle and the tobacco receptacle. The hinge system of the base and above the upper surface of the base so operation of the hinge does not interfere with the integrity of the tobacco receptacle. The lid moves between an open position, in which the first opening and the second opening are uncovered to provide access to contents of the smoking pipe receptacle and the tobacco receptacle, and a closed position, in which the first opening and the second opening are covered to prevent contents in the smoking pipe receptacle and the tobacco receptacle from exiting the base through the first opening and the second opening.

In another aspect, the present invention relates to a method of making a smoking accessory having a base and a lid pivotally connected to the base by a hinge. The method comprises forming a channel in the base and the lid, and inserting a lid attachment piece which extends above the base to form a stationary knuckle above the base. The lid is fitted on the base so the knuckle extends into the channel in the lid. A pilot hole is formed through the lid and the knuckle and a hinge pin is inserted in the pilot hole to form the hinge.

In yet another aspect, the present invention relates to a method of making a smoking accessory having a base and a lid pivotally connected to the base. The method comprises forming a channel in the base and the lid, and inserting a lever having a notch defining a latch in the channel in the base so the lever extends above the base. A stud is mounted in the channel in the lid so that the stud is aligned with the latch. A pilot hole is formed through the base and the lever and a lever pin is inserted in the pilot hole to pivotally connect the lever to the base.

BRIEF DESCRIPTION OF THE DRAWINGS

Corresponding reference characters indicate corresponding parts throughout the drawings.

DETAILED DESCRIPTION OF THE DRAWINGS

Figure 1:
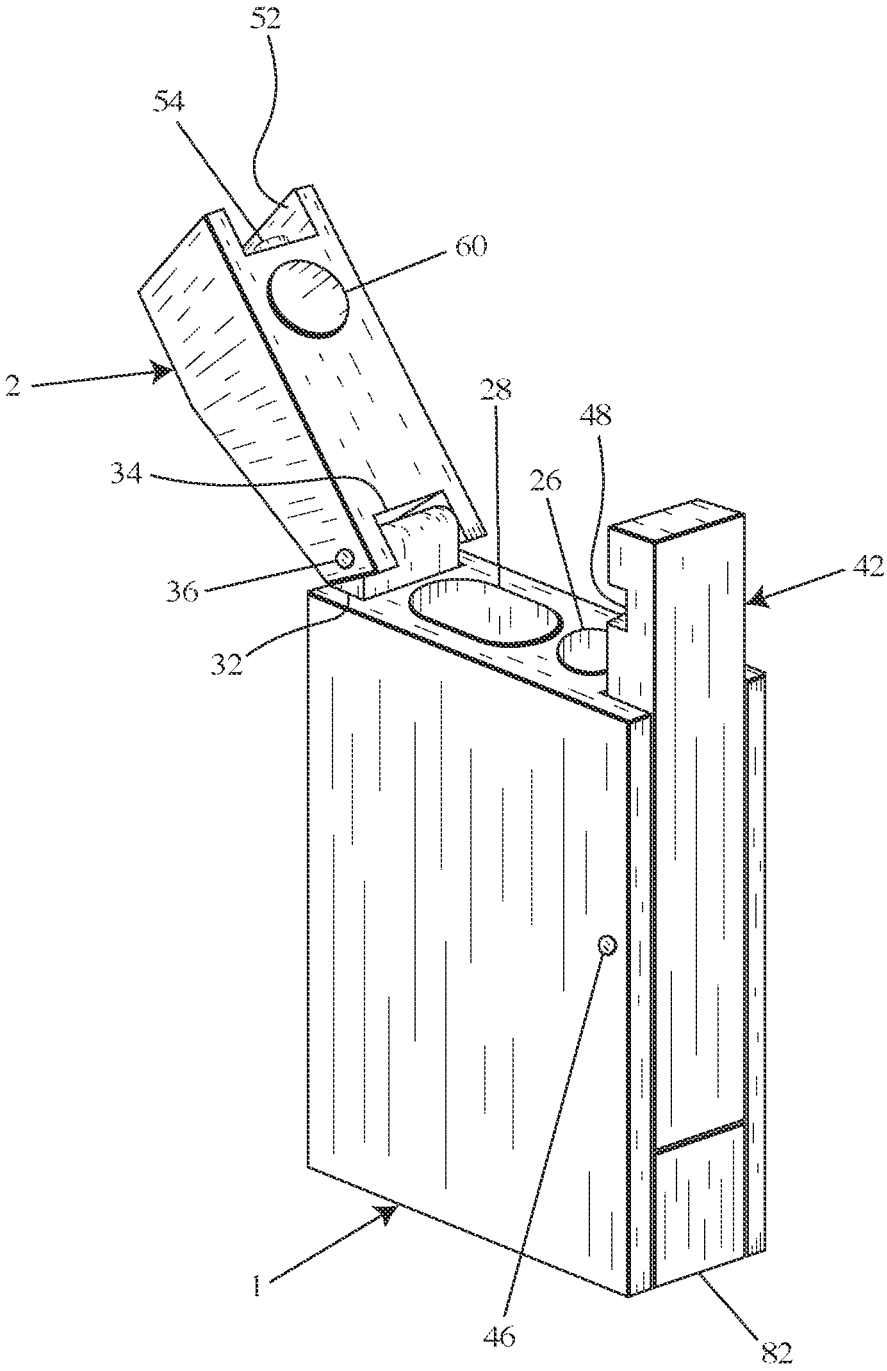
FIG. 1 is a perspective of a smoking accessory of a first embodiment of the present invention showing a lid in an open position.

Referring to FIG. 1, a smoking accessory of a first embodiment of the present invention generally comprises a base 1 and a lid 2 pivotally connected to the base. The base 1 includes a first elongate cavity or pipe receptacle 26 sized and shaped for receiving a conventional straight pipe P (FIG. 10) for smoking and a second elongate cavity or tobacco receptacle 28 adapted to receive tobacco. Although the first and second cavities may have other shapes without departing from the scope of the present invention, in one embodiment both of the cavities 26, 28 are cylindrical. It is envisioned each of the cavities may have shapes and sizes that differ from the other cavity. For example, the first cavity may be cylindrical, and the second cavity may have an oblong racetrack-shaped cross section, commonly referred to a mortise, and be a larger interior volume than the first cavity.

Figure 5:
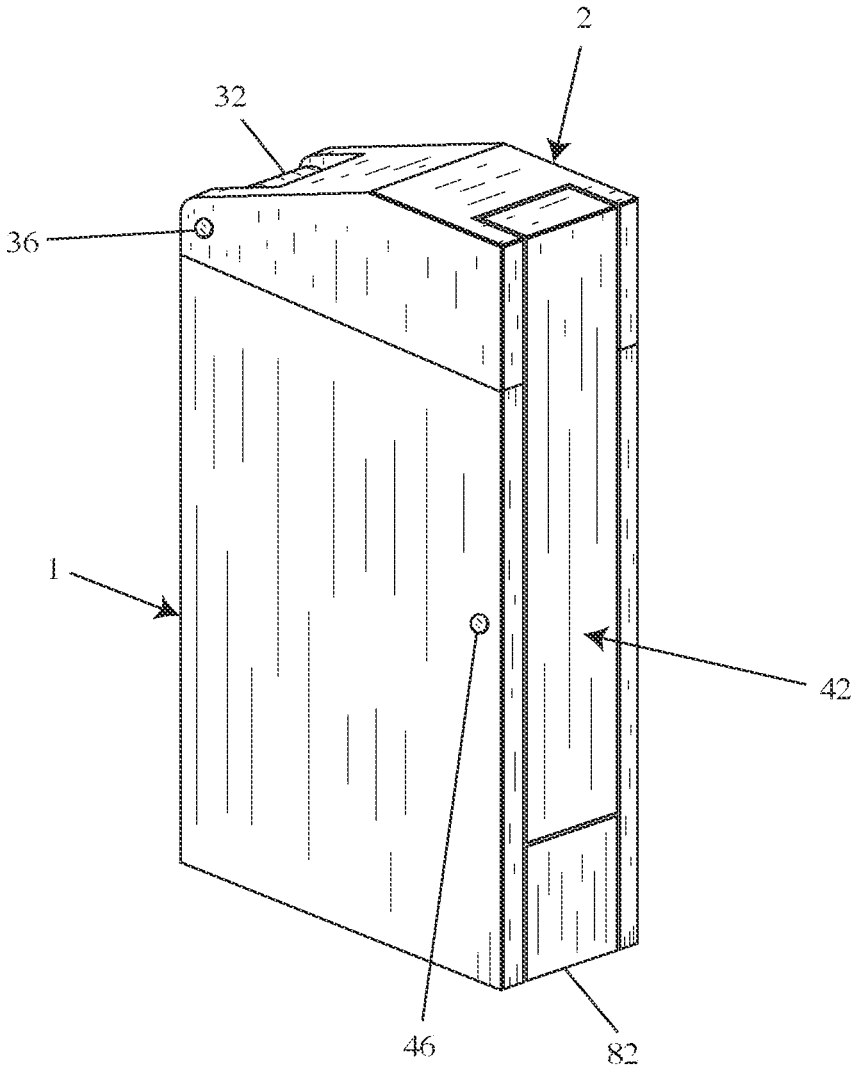
FIG. 5 is a perspective of the accessory showing the lid in a closed position.
Figure 6:
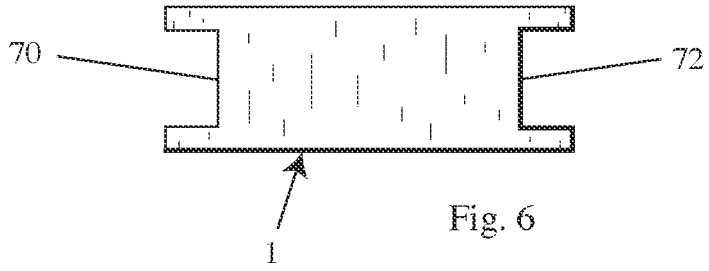
FIG. 6 is a top plan of the smoking accessory during the initial manufacturing operation.
Figure 7:
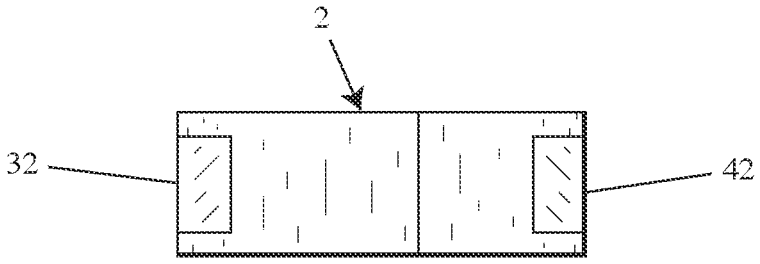
FIG. 7 is a top plan of the accessory showing the lid in the closed position.
Figure 8:
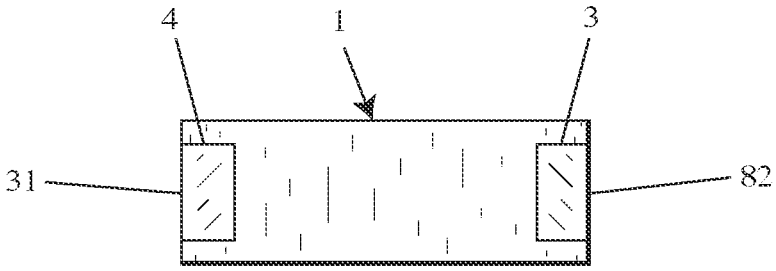
FIG. 8 is a bottom plan of the accessory.

A hinge mechanism pivotally connects the lid 2 to the base 1, allowing the lid to pivot between an open position as shown in FIG. 1 and a closed position as shown in FIG. 5. As shown in FIG. 1, the hinge mechanism includes a knuckle 32 extending upward from an upper face of the base 1 adjacent the tobacco receptacle 28. The recess 34 in the lid 2 receives the knuckle 32 and a hinge pin 36 extends through holes (not shown) formed in the knuckle and lid. The hinge pin 36, which is positioned entirely above the tobacco receptacle 28, permits the lid 2 to pivot with respect to the base 1. It is seen, therefore, that the lid 2 is pivotally connected to the base by hinge, and that the knuckle of the hinge is located above the upper surface of the base 1 and therefore above the opening for the tobacco receptacle 28. The hinge mechanism is therefore independent of the tobacco receptacle. The lid is therefore designed for selective movement in directions toward and away from the smoking pipe receptacle and the tobacco receptacle between an open position (FIG. 1), in which the first opening (to receptacle 28) and the second opening (to receptacle 26) are uncovered to provide access to contents of the smoking pipe receptacle and the tobacco receptacle, and a closed position (FIG. 5), in which the first opening and the second opening are covered to prevent contents in the smoking pipe receptacle and the tobacco receptacle from exiting the base through the first opening and the second opening. Because the hinge is located above the upper surface of the base—in contrast to the design in U.S. Pat. No. 5,967,312—the above described shortcomings of the '312 design are overcome. In particular, with the current invention, operation of the hinge so the lid is in the open position provides access to the tobacco receptacle only through the opening at 28 (FIG. 1) in the upper surface of the base. Access along the side walls of the tobacco receptacle at the hinge are avoided, which is not the case in the '312 design. Accordingly, the design of the invention prevents interference of the hinge with the interior of the tobacco receptacle.

Figure 9:
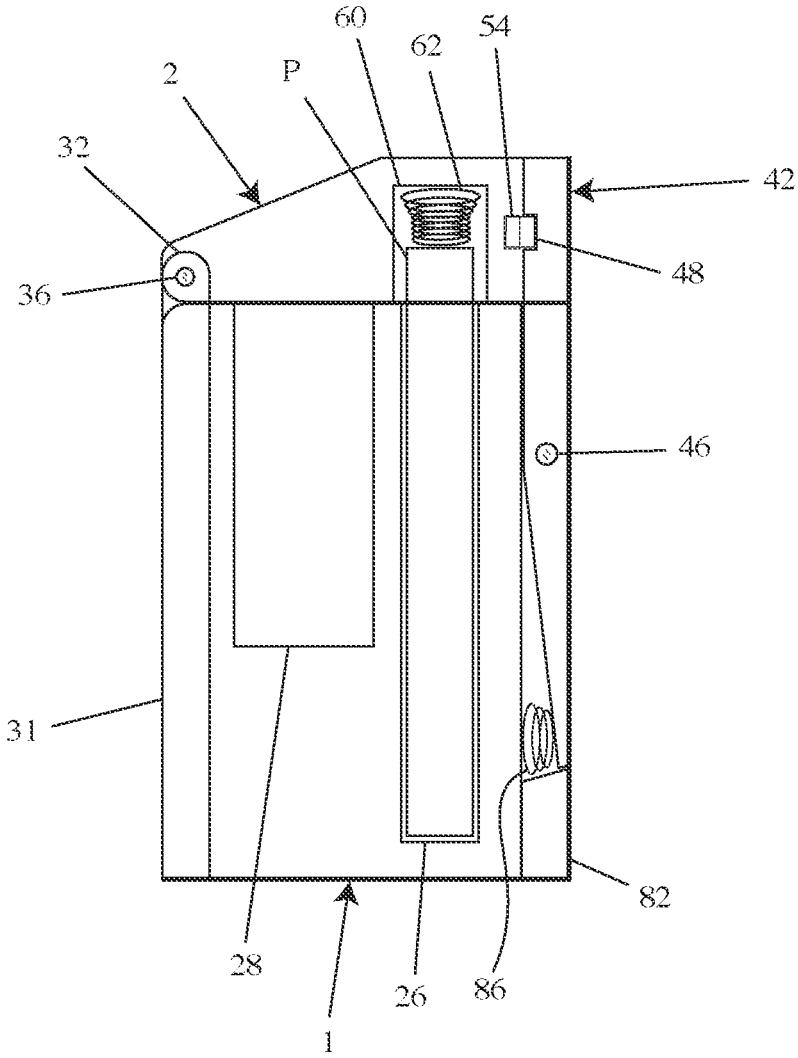
FIG. 9 is a schematic cross section of the accessory.

A latching mechanism is provided on the smoking accessory generally opposite the hinge mechanism for holding the lid 2 in the closed position. The latching mechanism includes a lever 42 pivotally mounted in a recess 72 provided in the base 1. A lever pin 46 extends through holes (not shown) formed in the base 1 and lever 42 to permit the lever to pivot between a latched position shown in FIG. 1 and an unlatched position shown in FIG. 10. As further illustrated in FIG. 1, the lever 42 includes a notch 48 forming a hook which defines a latch of the latching mechanism. The lid 2 includes a recess 52 for receiving a portion of the lever 42 of the latching mechanism. A stud 54 which shown here is a horizontally protruding rod is mounted in the recess 52 for engaging the notch 48 when the latching mechanism is in the latched position to hold the lid 2 in the closed position as will be apparent to those skilled in the art. The stud 54 may be bonded in a hole (not shown) in the lid 2 to hold the stud in place. Although the stud 54 may be made of other materials without departing from the scope of the present invention, in one embodiment the stud is made from a brass alloy. As can be seen in FIG. 9, the lever has a tapered lower end to accommodate the spring 86 and allow for movement of the lever and hence the latching mechanism between open and closed positions.

Figure 10:
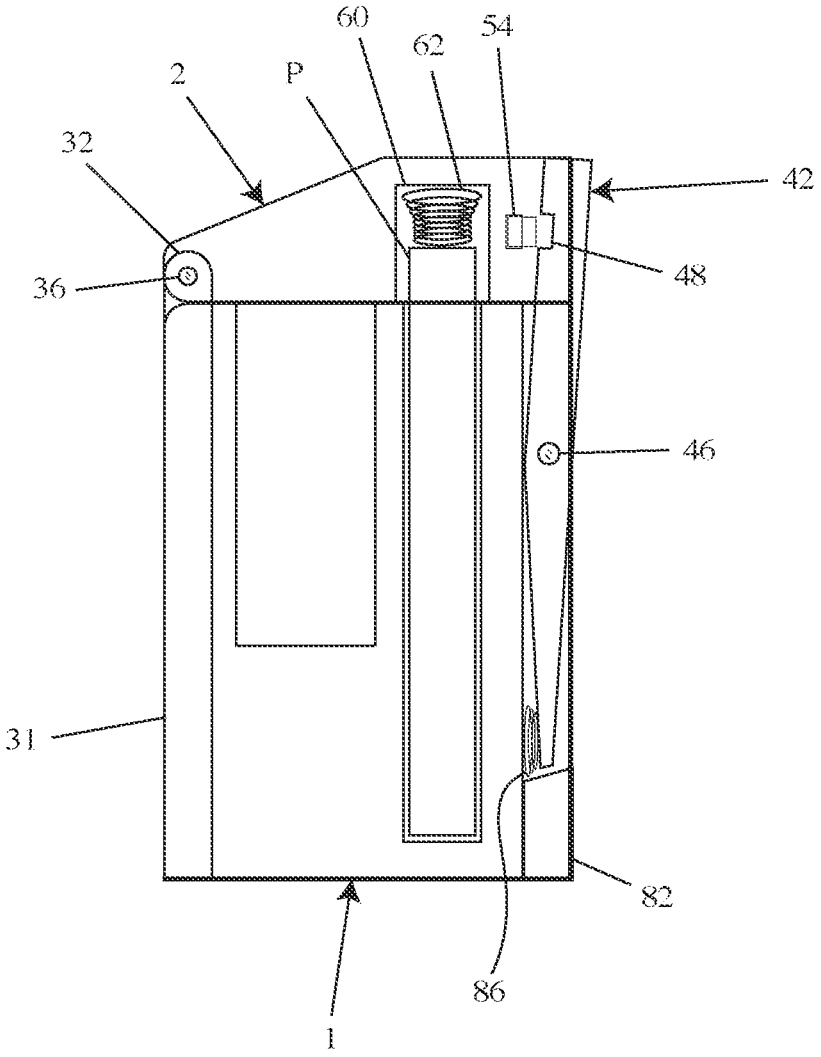
FIG. 10 is a schematic cross section of the accessory showing a latching mechanism unlatched.

The lid 2 also includes a recess 60 sized for receiving a spring 62 and the upper portion of the pipe which protrudes into recess 60 when the lid is closed (FIG. 10). The spring 62 engages the pipe P when the lid 2 is in the closed position to keep the pipe from moving around in the pipe receptacle 26. The spring 62 also pushes the lid 2 toward the open position when the lever 42 of the latching mechanism is moved to the unlatched position.

Figure 2:
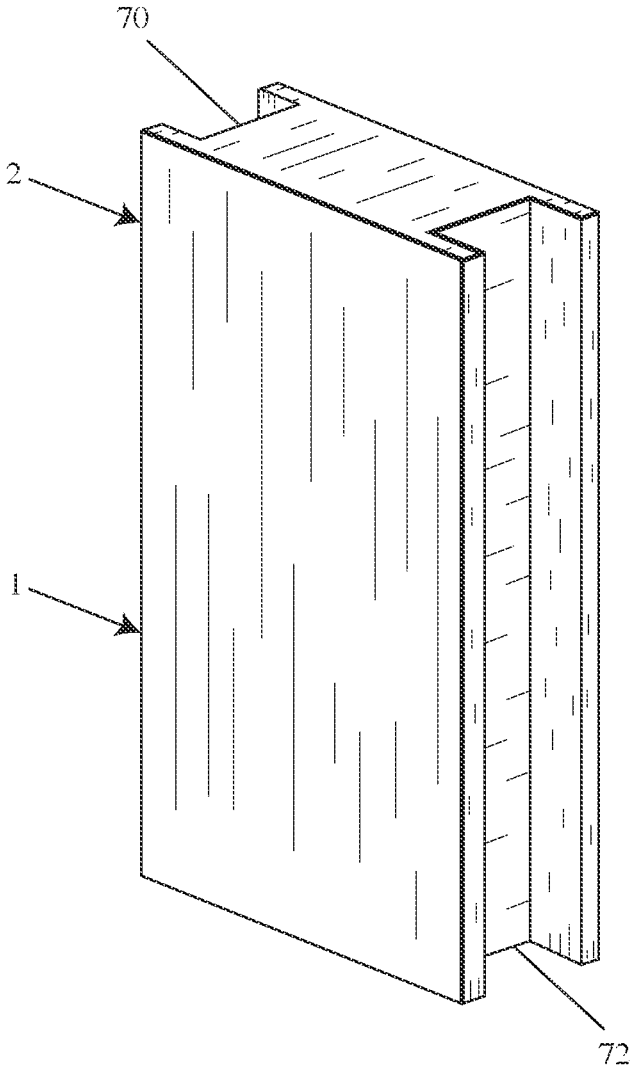
FIG. 2 is a perspective of a portion of the smoking accessory during an initial manufacturing operation.
Figure 3:
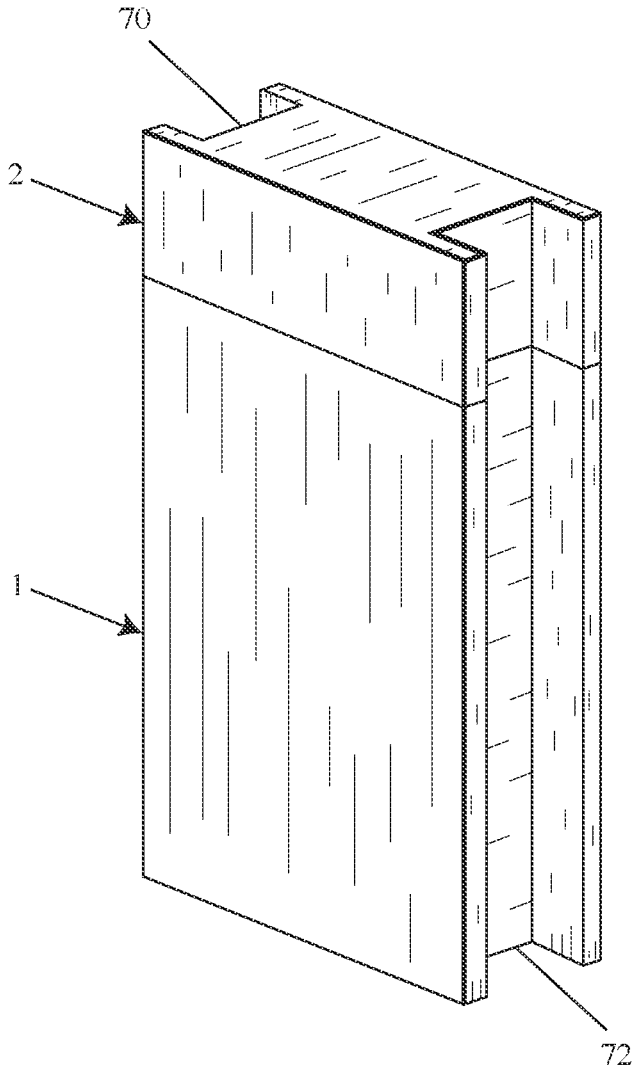
FIG. 3 is a perspective of the portion after a sawing operation during which a lid is separated from a base.
Figure 4:
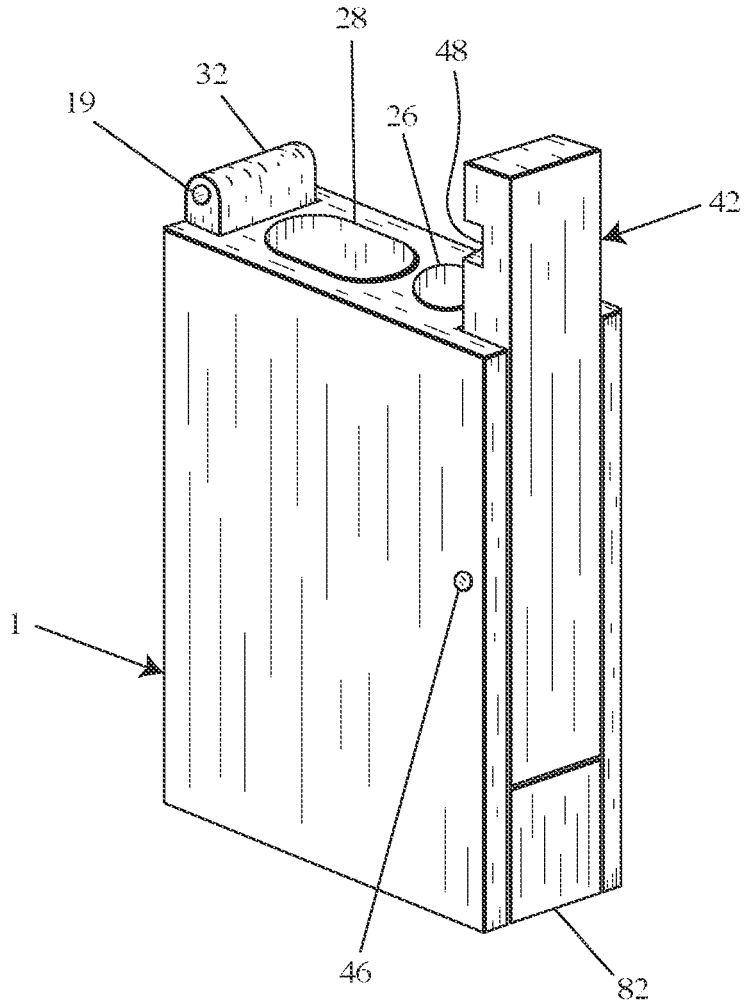
FIG. 4 is a perspective of the base showing the lid removed.

The smoking accessory of the first embodiment is made from wood. As shown in FIG. 2, central portions of the base 1 and lid 2 are made from a solid block of wood having a hinge channel 70 milled along one side and a latch channel 72 milled along an opposite side. The invention therefore involves forming a channel (two channels) in the base and in the lid. It will be understood that it is best to form these channels 70 and 72 in the base and in the lid by milling out these channels as a solid block of wood before cutting the block into the base and lid components. The preferred method for forming a channel in the base and the lid comprises forming the channel in a solid block of wood and then cutting said block of wood into two components defining the base and the lid. The block sawed in two is shown in FIG. 3. A larger part of the sawed block will form the base 1 and a smaller part of the sawed block will become the lid 2. As illustrated in FIG. 4, the first and second cavities 26, 28 are bored into the larger part of the sawed block. As shown illustrated in FIG. 1, the recess 60 is bored into the smaller part of the sawed block and the spring 62 is installed in the recess. Further, a hole (not shown) is made in the lid inside the latch channel 72 and the stud 54 is fastened in the hole. Although the spring 62 and stud 54 may be connected to the lid 2 using other conventional procedures, in one embodiment, they are adhesively bonded in position.

FIG. 9 shows the lid attachment piece 31 inserted in the hinge channel 70. Although the lid attachment piece 31 may be fastened to the base 1 with the knuckle 32 extending upwardly above the base using other conventional procedures, in one embodiment they are adhesively bonded together. Once the knuckle 32 is in place, the base 1 and lid 2 are fitted together and a pilot hole 19 (in FIG. 4) is made through the lid and the knuckle. The hinge pin 36 is driven into the pilot hole to pivotally connect the lid 2 to the base 1.

FIG. 9 also shows end piece 82 inserted in the latch channel 72. Although the end piece 82 may be fastened to the base 1 and lid 2, respectively, using other conventional procedures, in one embodiment they are adhesively bonded together. The lever 42 of the latching mechanism is trial fit in the latch channel 72 and a pilot hole is made through the base 1 and lever. A spring 86 is inserted in the latch channel 72 as shown in FIG. 10 and the lever 42 is positioned in the channel over the spring. Once the lever 42 is in position, the lever pin 46 is driven through the pilot hole to pivotally fasten the lever in place in the channel 72. As will be appreciated by those skilled in the art, the hinge pin 36, the lever pin 46, the knuckle 32, and the end pieces may be longer than their respective final dimensions when installed. Once the accessory is completely assembled, the pins 36, 46, knuckle 32, and end pieces may be ground and sanded to their final lengths. The system may be finished as desired; for example, the system may be left unfinished or it may be decorated with wood, metal, and/or stone inlays.

Figure 11:
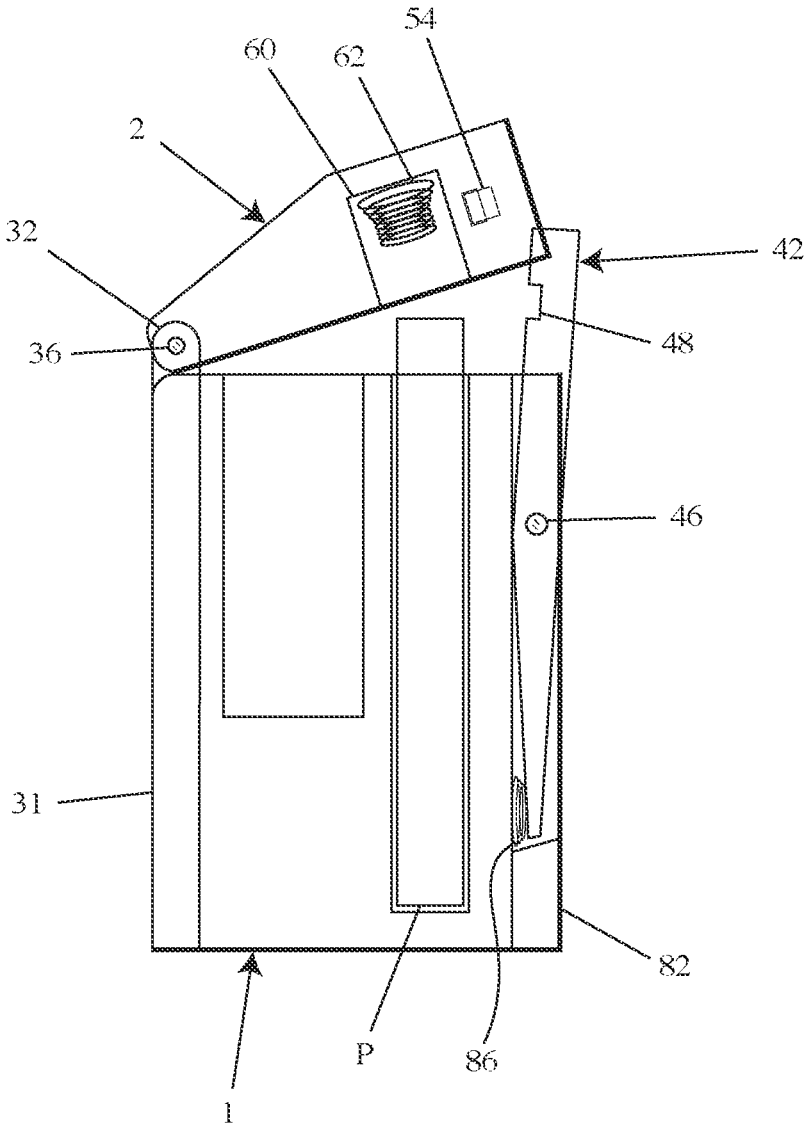
FIG. 11 is a schematic cross section of the accessory showing the lid part way between the closed position and the open position.
Figure 12:
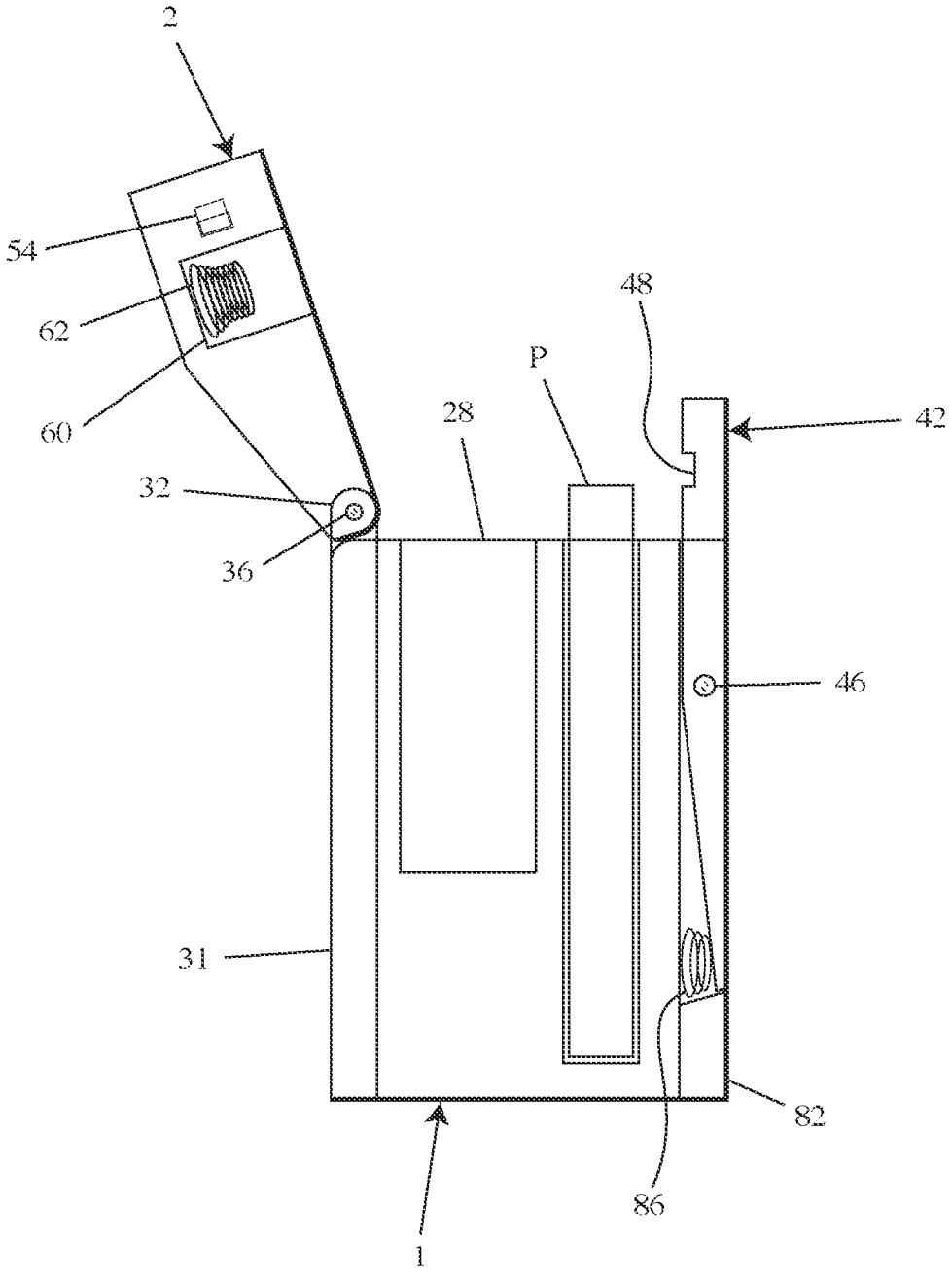
FIG. 12 is a schematic cross section of the accessory showing the lid in the open position.

To use the accessory, a pipe P is placed in the pipe receptacle 26 and tobacco is placed in the tobacco receptacle 28 before the lid 2 is closed. As the lid 2 closes, the stud 54 engages a portion the lever 42 above the notch 48, causing the latching mechanism to move toward the unlatched position as shown in FIG. 10. When the lid 2 is fully closed, the spring 86 moves the lever 42 toward the latched position (shown in FIG. 12) so the notch 48 of the latch receives the stud 54 to hold the lid in the closed position. When a user desires to gain access to the receptacles, the lever 42 is depressed to the position shown in FIG. 11 and the spring 62 propels the lid 2 away from the base 1 toward the open position shown in FIG. 12. The user removes the pipe P, inserts the pipe in the tobacco receptacle 28 to load the pipe with tobacco, and closes the lid 2.

As will be appreciated by those skilled in the art, the configuration of the hinge mechanism eliminates tobacco from spilling out a side of the tobacco receptacle 28 when the lid 2 is in the open position. Further, the configuration prevents the mechanism from pushing tobacco out of the receptacle 28 when the lid 2 is opened and closed. Still further, the configuration of the latching mechanism eliminates the need for complex milling operations and lamination to manufacture the accessory.

Having described the invention in detail, it will be apparent that modifications and variations are possible without departing from the scope of the invention defined in the appended claims.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A smoking accessory comprising:

a base including an upper surface having two openings therein, a first opening of said two openings providing access to a pipe receptacle extending into the base from the first opening sized and shaped for holding a smoking pipe and a second opening of said two openings providing access to a tobacco receptacle adapted for storing tobacco extending into the base from the second opening; and a lid pivotally connected to the base by a hinge located above the upper surface of the base for selective movement in directions toward and away from the smoking pipe receptacle and the tobacco receptacle between an open position, in which the first opening and the second opening are uncovered to provide access to contents of said smoking pipe receptacle and said tobacco receptacle, and a closed position, in which the first opening and the second opening are covered to prevent contents in the smoking pipe receptacle and the tobacco receptacle from exiting the base through the first opening and the second opening;

wherein the base and the lid are made from a solid block of wood and each have a hinge channel milled along one side and a latch channel milled along an opposite side;

wherein the hinge channel and the latch channel each extend the entire length of the base and the lid;

wherein a lid attachment piece inserted into the hinge channel extends the entire length of the base and has a knuckle which extends above the upper surface of the base and is a component of the hinge for the lid;

wherein a lever component of a latching mechanism for latching the lid to the base is pivotally attached to one of the base or the lid and said lever component is inserted into the latch channel.

2. A smoking accessory as set forth in claim 1 wherein the tobacco receptacle is substantially free of openings other than at the upper surface of the base.

3. A smoking accessory as set forth in claim 1 wherein the hinge comprises:

the knuckle of the lid attachment piece attached to the base and extending above the upper surface thereof; and a hinge pin extending through the lid and the knuckle to permit the lid to pivot between the open position and the closed position.

4. A smoking accessory as set forth in claim 1 further comprising a latching mechanism for latching the lid when in the closed position.

5. A smoking accessory as set forth in claim 4 wherein the latching mechanism comprises:

the lever pivotally attached to one of the base and lid, the lever having a notch therein; and a stud on another of the base and lid for engaging the notch in the lever when the lid is in the closed position.

6. A smoking accessory as set forth in claim 5 wherein: the lever is pivotally attached to the base; and the stud is on the lid.

7. A smoking accessory of claim 6 wherein the stud protrudes from the latch channel in the lid.

8. A smoking accessory as set forth in claim 1 in combination with a smoking pipe.

9. A smoking accessory as set forth in claim 1 wherein:

the tobacco receptacle is free of openings other than at the upper surface of the base;

the hinge comprises the knuckle of the lid attachment piece attached to the base and extending above the upper surface thereof and a hinge pin extending through the lid and the knuckle to permit the lid to pivot between the open position and the closed position; and a latching mechanism for latching the lid when in the closed position, wherein the latching mechanism comprises the lever pivotally attached to one of the base and lid, the lever having a notch therein, and a stud protruding from another of the base and lid for engaging the notch in the lever when the lid is in the closed position.

10. The smoking accessory of claim 1 wherein the latch channel of the base and lid each have a rectangular profile for receiving the lever component inserted into the latch channel of the base and lid, and the lever component has a rectangular profile.

11. The smoking accessory of claim 1 wherein:

the hinge channel of the base and lid each have a rectangular profile for receiving the inserted lid attachment piece and knuckle of the lid attachment piece, and the lid attachment piece has a rectangular profile;

the latch channel of the base and lid each have a rectangular profile for receiving the lever component inserted into the latch channel of the base and lid, and the lever component has a rectangular profile.

12. The smoking accessory of claim 1 wherein:

the hinge channel of the base and lid each have a rectangular profile for receiving the inserted lid attachment piece and knuckle of the lid attachment piece, and the lid attachment piece has a rectangular profile; and the lever component of the latching mechanism for latching the lid to the base is pivotally attached to the base.

13. The smoking accessory of claim 1 wherein:

the latch channel of the base and lid each have a rectangular profile for receiving the lever component inserted into the latch channel of the base and lid, and the lever component has a rectangular profile; and the lever component of the latching mechanism for latching the lid to the base is pivotally attached to the base.

14. The smoking accessory of claim 1 wherein:

the hinge channel of the base and lid each have a rectangular profile for receiving the inserted lid attachment piece and knuckle of the lid attachment piece, and the lid attachment piece has a rectangular profile;

the latch channel of the base and lid each have a rectangular profile for receiving the lever component inserted into the latch channel of the base and lid, and the lever component has a rectangular profile; and the lever component of the latching mechanism for latching the lid to the base is pivotally attached to the base.

15. The smoking accessory of claim 13 further comprising an end piece inserted into the latch channel of the base, wherein the end piece has a rectangular profile.

* * * * *